US006302240B1

(12) United States Patent
Shih

(10) Patent No.: US 6,302,240 B1
(45) Date of Patent: Oct. 16, 2001

(54) AUXILIARY SAFETY LIFT DEVICE FOR THE CAB OF AN ELEVATOR

(76) Inventor: Kuei-Tang Shih, No. 46, Nong 12, Lane 108, Yong-Feng Rd., Tai-Ping Hsiang, Taichung Hsien (TW)

( * ) Notice: Subject to any disclaimer, the term of this patent is extended or adjusted under 35 U.S.C. 154(b) by 0 days.

(21) Appl. No.: 09/596,696

(22) Filed: Jun. 19, 2000

(51) Int. Cl.[7] ..... B66B 7/00
(52) U.S. Cl. ..... 187/414; 187/397
(58) Field of Search ..... 187/290, 298, 187/391, 395, 397, 396, 414, 291, 284; 200/520, 530, 532

(56) References Cited

U.S. PATENT DOCUMENTS

| | | | | |
|---|---|---|---|---|
| 5,581,057 | * | 12/1996 | Ferrario et al. | 187/396 |
| 5,740,888 | * | 4/1998 | Aulanko et al. | 187/336 |
| 5,971,109 | * | 10/1999 | Aulanko et al. | 187/263 |
| 6,029,778 | * | 2/2000 | Lacarte Estallo | 187/414 |
| 6,227,335 | * | 5/2001 | Koeppe, Jr. et al. | 187/414 |

FOREIGN PATENT DOCUMENTS

1285568-A * 1/1989 (JP) .

* cited by examiner

*Primary Examiner*—Jonathan Salata
(74) *Attorney, Agent, or Firm*—Charles E. Baxley

(57) ABSTRACT

An auxiliary safety lift device for a cab of an elevator includes a box having a first side defining a through hole and a second side defining a chamber, a slide groove defined in a front side of the chamber, an inspection board made of transparent material secured in the second side of the box and aligning with the through hole of the box so that a user can view and inspect an ambient environment from the inspection board through the through hole of the box, a control panel secured in the chamber of the box and defining a plurality of receiving spaces, a plurality of control buttons each secured in a respective one of the receiving spaces of the control panel, a safety board slidably secured in the slide groove of the chamber of the box, an outer cover plate pivotally mounted on the box for encompassing the box, and two sensors, wherein a first one of the two sensors is mounted between the box and the outer cover plate, and a second one of the two sensors is mounted on one side of the safety board.

4 Claims, 4 Drawing Sheets

AUXILIARY SAFETY LIFT DEVICE FOR THE CAB OF AN ELEVATOR

BACKGROUND OF THE INVENTION

1. Field of the Invention

The present invention relates to an auxiliary safety lift device, and more particularly to an auxiliary safety lift device for the cab of an elevator.

2. Description of the Related Art

A conventional safety device for the cab of an elevator comprises a press button which is connected to that of the alarm bell of the guard of the building so that when a person is limited in the cab of the elevator, the user may inform the guard of the accident.

However, when the elevator is stopped, the user limited in the cab of the elevator cannot assure the height and position of the elevator so that he cannot escape from the elevator by himself and has to stay in the cab of the elevator and wait continuously until the rescuer arrives. In such a manner, when the fire, the earthquake or the like takes place, the user limited in the cab of the elevator is easily hurt due to the accident.

In addition, when the control system of the elevator fails, the brake of the power supply will automatically lock the elevator to prevent the elevator from falling down so that the elevator easily stops between two adjacent floors.

However, the user limited in the cab of the elevator cannot control the position of the elevator by himself Therefore, when the rescuer opens the door of the elevator, the user has to climb upward or downward from the elevator through a certain distance so as to reach the opening of the nearest floor, thereby easily causing danger to the user.

SUMMARY OF THE INVENTION

The present invention has arisen to mitigate and/or obviate the disadvantage of the conventional safety device for the cab of an elevator.

In accordance with one aspect of the present invention, there is provided a auxiliary safety lift device for a cab of an elevator comprising: a box having a first side defining a through hole and a second side defining a chamber, and a slide groove defined in a front side of the chamber; an inspection board made of transparent material secured in the second side of the box and aligning with the through hole of the box so that a user can view and inspect an ambient environment from the inspection board through the through hole of the box; a control panel secured in the chamber of the box and defining a plurality of receiving spaces therein; a plurality of control buttons each secured in a respective one of the receiving spaces of the control panel; a safety board slidably secured in the slide groove of the chamber of the box; an outer cover plate pivotally mounted on the box for encompassing the box; and two sensors, a first one of the two sensors mounted between the box and the outer cover plate, and a second one of the two sensors mounted on one side of the safety board.

In practice, the inspection board co-operates with an indication line on an inner wall of the elevator so that the user can clearly inspect the position of the cab of the elevator in a building.

Accordingly, the auxiliary safety lift device of the present invention works in conjunction with the spare power so that the user limited in the cab of the elevator can inspect the relative position of the cab of the elevator in the building according to the safe and automatic operational procedures of the auxiliary safety lift device so as to escape from the cab of the elevator by himself, thereby achieving a safety function for protecting the user limited in the cab of the elevator.

Further benefits and advantages of the present invention will become apparent after a careful reading of the detailed description with appropriate reference to the accompanying drawings.

DETAILED DESCRIPTION OF THE INVENTION

Figure 1:
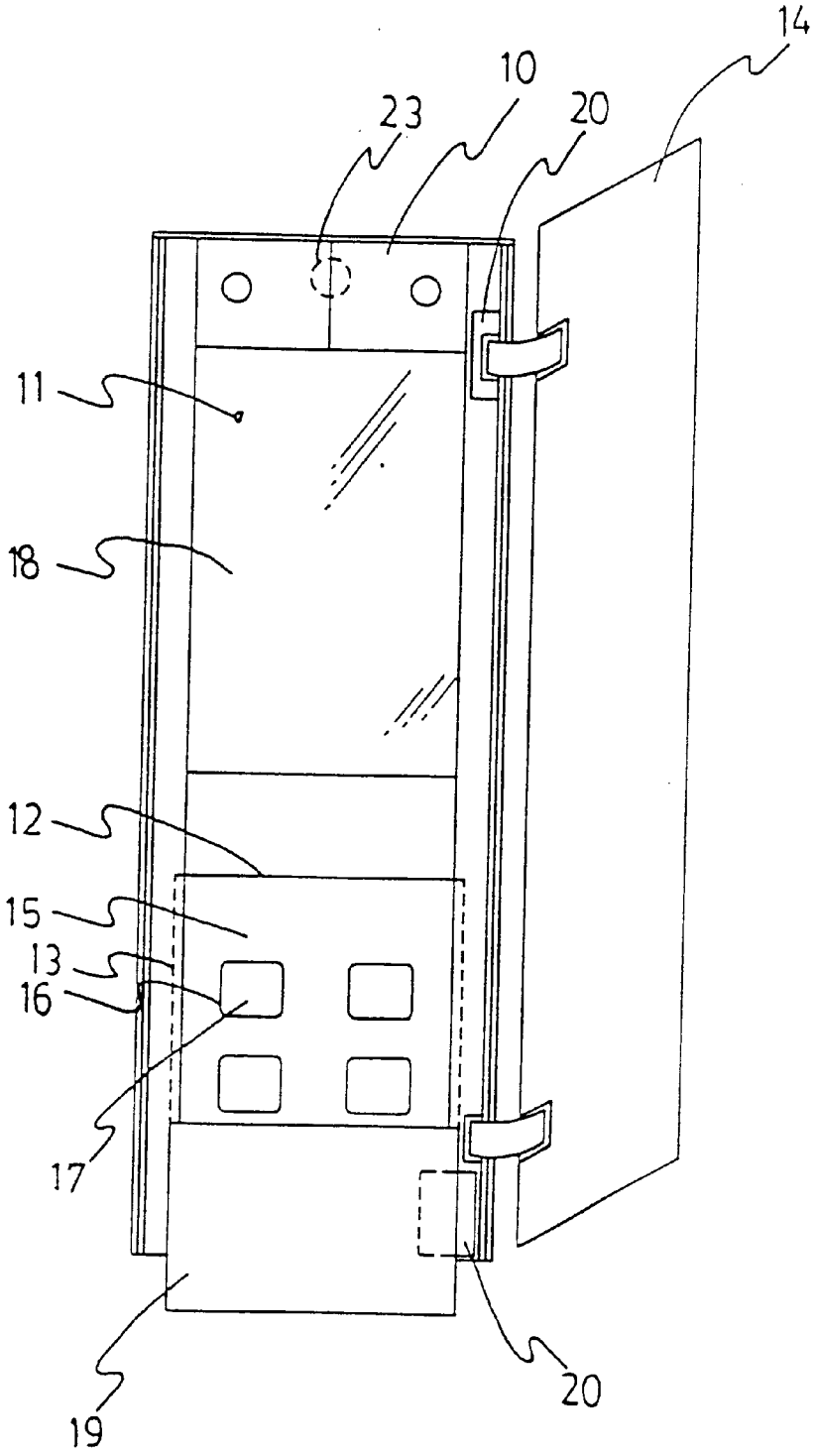
FIG. 1 is a front plan view of an auxiliary safety lift device for a cab of an elevator in accordance with the present invention.
Figure 2:
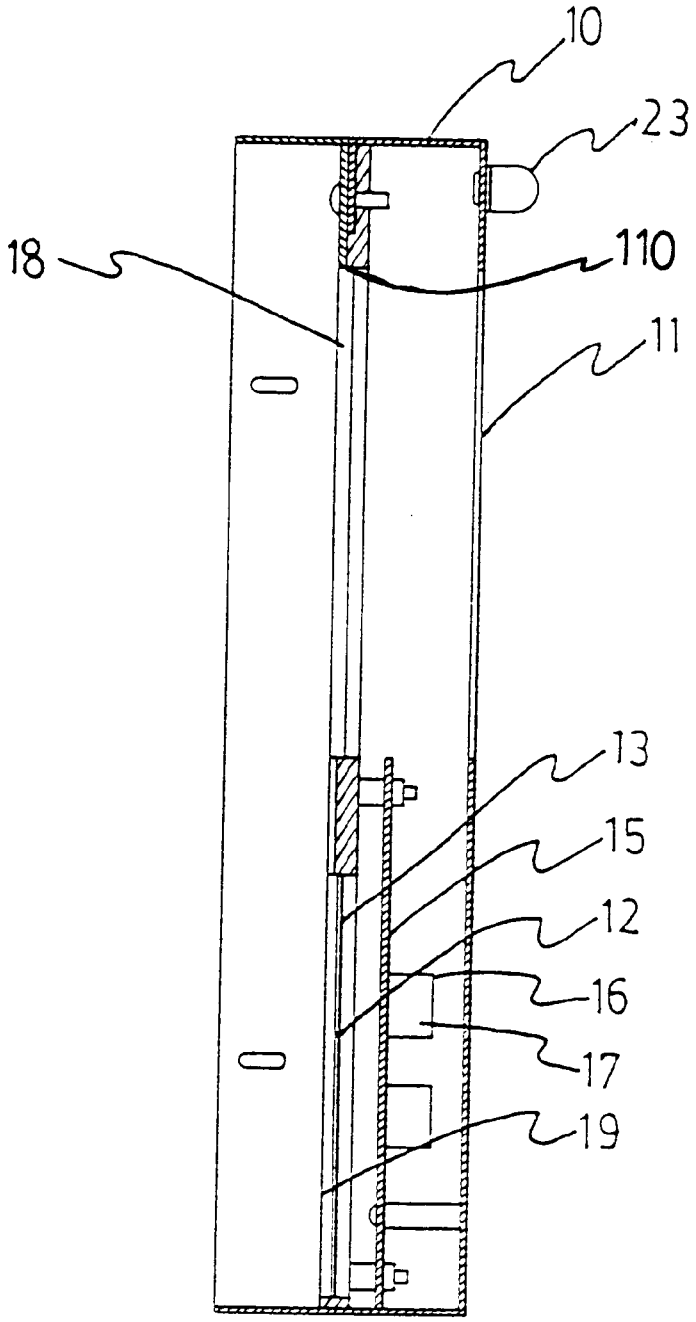
FIG. 2 is a side plan cross-sectional view of the auxiliary safety lift device as shown in FIG. 1.

Referring to the drawings and initially to FIGS. 1 and 2, an auxiliary safety lift device for a cab of an elevator in accordance with the present invention comprises a box 10 including a first side having an upper portion defining a through hole 11 and a second side having a lower portion defining a chamber 12, a slide groove 13 defined in a front side of the chamber 12, an indication lamp 23 secured on the first side of the box 10, an inspection board 18 made of transparent material secured in the upper portion of the second side of the box 10 and aligning with the through hole 11 of the box 10 so that a user can view and inspect the ambient environment from the inspection board 18 through the through hole 11 of the box 10, a control panel 15 secured in the chamber 12 of the box 10 and defining a plurality of receiving spaces 16 therein, a plurality of, e.g., four control buttons 17 each secured in a respective one of the receiving spaces 16 of the control panel 15, a safety board 19 slidably secured in the slide groove 13 of the chamber 12 of the box 10, an outer cover plate 14 pivotally mounted on the box 10 for encompassing the box 10, and two sensors 20.

A first one of the two sensors 20 is mounted between the box 10 and the outer cover plate 14, and the second one of the two sensors 20 is mounted on one side of the safety board 19.

The box 10 has an opened front side, and the second side of the box 10 has a positioning hole 110 defined in the upper portion thereof for securing the inspection board 18 therein.

Figure 3:
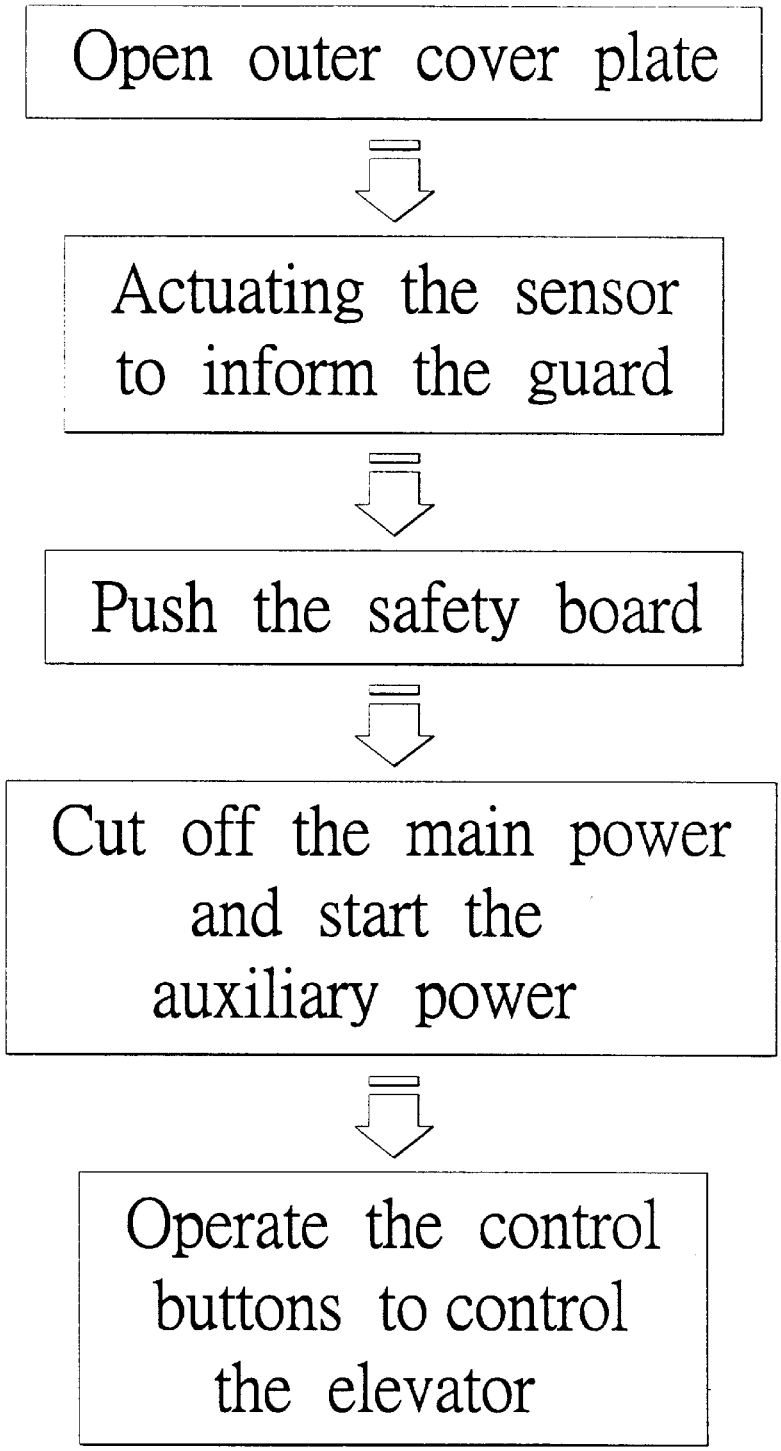
FIG. 3 is a flow chart showing the operational procedures of the auxiliary safety lift device as shown in FIG. 1.
Figure 4:
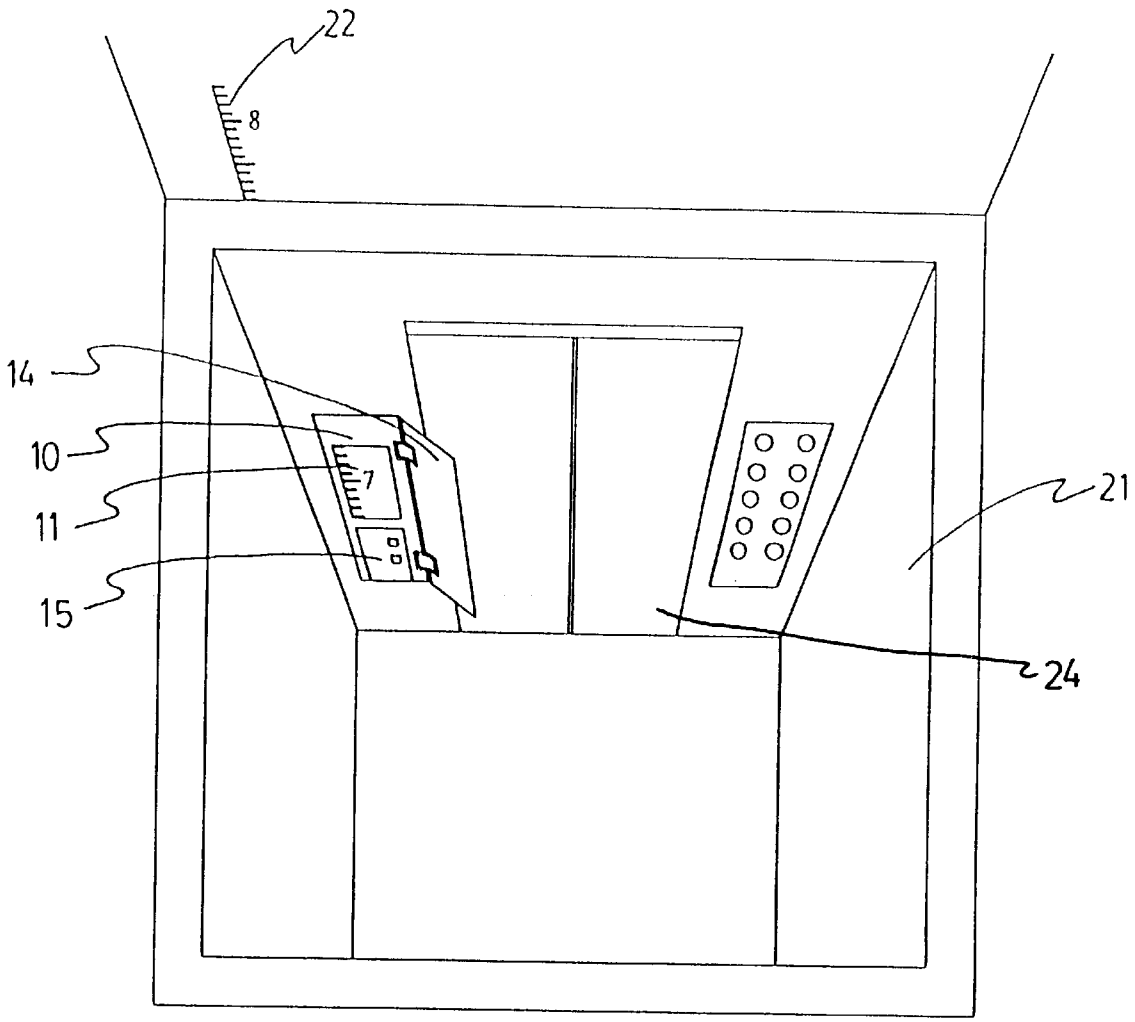
FIG. 4 is a schematic operational view of the auxiliary safety lift device as shown in FIG. 1 in use.

In operation, referring to FIGS. 3 and 4 with reference to FIGS. 1 and 2, the cab 21 of the elevator stops moving when the electricity is cutoff or when the control system (not shown) of the elevator is inoperative. In such a manner, the user limited in the cab 21 of the elevator may open the outer cover plate 14 so that the first sensor 20 located between the box 10 and the outer cover plate 14 is triggered and actuated to connect and start the guard system (not shown) and the warning system (not shown) of the elevator so as to inform the person or operator outside the elevator of the accident incurred in the cab 21 of the elevator.

At the same time, the indication lamp 23 lights simultaneously so that the user may view and inspect the ambient environment from the inspection board 18 through the through hole 11 of the box 10 by means of illumination of the indication lamp 23.

In such a manner, the inspection board 18 can co-operate with an indication line 22 on an inner wall of the elevator so that the user can clearly inspect the current position of the cab 21 of the elevator in the building, and can also inspect the ambient conditions to see if any fire, smoke or the like is generated.

If the user wishes to escape from the cab 21 of the elevator by himself, he may push the safety board 19 to slide downward in the slide groove 13 so that the second sensor 20 secured on the safety board 19 can be triggered and actuated so as to cutoff the power supply of the main power and the control system of the elevator, and to automatically actuate an auxiliary power such as an emergency spare electrical power and mechanism.

In such a manner, the user can safely press and operate the four control buttons 17 on the control panel 15 so as to lift, lower, open or close the door 24 of the elevator manually. At the same time, during movement of the elevator, the user can inspect the current position of the cab 21 of the elevator in the building by means of the inspection board 18 in conjunction with the through hole 11 of the box 10 so as to safely move to a predetermined floor of the building so that the user can escape from the cab 21 of the elevator safely.

Accordingly, in accordance with the present invention, by means of the auxiliary safety lift device in conjunction with the spare power, the user limited in the cab 21 of the elevator can inspect the relative position of the cab 21 of the elevator in the building according to the safe and automatic operation procedures of the auxiliary safety lift device so as to escape from the cab 21 of the elevator by himself, thereby achieving a safety function for protecting the user limited in the cab 21 of the elevator.

It should be clear to those skilled in the art that further embodiments may be made without departing from the scope of the present invention.

What is claimed is:

1. An auxiliary safety lift device for a cab of an elevator comprising:

a box (10) having a first side defining a through hole (11) and a second side defining a chamber (12), and a slide groove (13) defined in a front side of said chamber (12);

an inspection board (18) made of transparent material secured in said first side of said box (10) and aligning with said through hole (11) of said box (10) so that a user can view and inspect an ambient environment from said inspection board (18) through said through hole (11) of said box (10);

a control panel (15) secured in said chamber (12) of said box (10) and defining a plurality of receiving spaces (16) therein;

a plurality of control buttons (17) each secured in a respective one of said receiving spaces (16) of said control panel (15);

a safety board (19) slidably secured in said slide groove (13) of said chamber (12) of said box (10);

an outer cover plate (14) pivotally mounted on said box (10) for encompassing said box (10); and two sensors (20), a first one of said two sensors (20) mounted between said box (10) and said outer cover plate (14), and a second one of said two sensors (20) mounted on one side of said safety board (19).

2. The auxiliary safety lift device in accordance with claim 1, wherein said second side of said box (10) defines a positioning hole (10) for securing said inspection board (18) therein.

3. The auxiliary safety lift device in accordance with claim 1, further comprising an indication lamp (23) secured on said first side of said box (10).

4. The auxiliary safety lift device in accordance with claim 1, wherein said inspection board (18) co-operates with an indication line (22) on an inner wall of said elevator so that the user can clearly inspect the position of said cab of said elevator in a building.

* * * * *